US009683791B2

(12) United States Patent
Wu et al.

(10) Patent No.: US 9,683,791 B2
(45) Date of Patent: Jun. 20, 2017

(54) CONDENSATION ENHANCEMENT HEAT TRANSFER PIPE

(75) Inventors: Yongqiang Wu, Xinxiang (CN); Zhijun Wang, Xinxiang (CN); Hongguan Zhu, Xinxiang (CN); Qingxue Yue, Xinxiang (CN); Pengtao An, Xinxiang (CN); Tao Wang, Xinxiang (CN)

(73) Assignee: GOLDEN DRAGON PRECISE COPPER TUBE GROUP INC., Xinxiang, Henan (CN)

( * ) Notice: Subject to any disclaimer, the term of this patent is extended or adjusted under 35 U.S.C. 154(b) by 1190 days.

(21) Appl. No.: 12/980,609

(22) Filed: Dec. 29, 2010

(65) Prior Publication Data

US 2011/0226457 A1 Sep. 22, 2011

(30) Foreign Application Priority Data

Mar. 18, 2010 (CN) ..... 2010 1 0126915

(51) Int. Cl.
*F28F 1/42* (2006.01)
*F28F 13/04* (2006.01)
*F28D 21/00* (2006.01)

(52) U.S. Cl.
CPC ..... *F28F 1/422* (2013.01); *F28F 13/04* (2013.01); *F28D 2021/007* (2013.01); *F28F 2215/00* (2013.01); *F28F 2215/10* (2013.01)

(58) Field of Classification Search
CPC ... F28B 1/02; F28F 1/422; F28F 13/04; F28F 1/126; F28F 1/16; F28F 1/26; F28F 1/34; F28F 1/36; F28D 3/02
USPC ..... 165/133, 179, 184
See application file for complete search history.

(56) References Cited

U.S. PATENT DOCUMENTS 3,326,283 A * 6/1967 Ware ..... B21C 37/207 165/133
3,768,290 A * 10/1973 Zatell ..... B21C 37/20 165/133
4,168,618 A * 9/1979 Saier ..... B21C 37/207 165/184

(Continued)

FOREIGN PATENT DOCUMENTS

CN 2798021 Y 7/2006
CN 1982828 A 6/2007

(Continued)

*Primary Examiner* — Len Tran
*Assistant Examiner* — Gustavo Hincapie Serna
(74) *Attorney, Agent, or Firm* — Wilson Sonsini Goodrich & Rosati

(57) ABSTRACT

A condensation enhancement heat transfer pipe that includes an optical pipe section, a fin section, and a transition section connecting the optical pipe section and the fin section. The outer surface of the fin section includes a plurality of individual fins, each having an acute shape of zigzag and forms an angle relative to the axial direction, an axial fin channel forms between the two adjacent ones of said individual fins along the axial direction, a peripheral fin channel forms between the two adjacent ones of said individual fins along the peripheral direction, an end, which is distributed along said axial direction, of each of said individual fins includes platforms, the fin side walls are connected with the platform by an arc, and the platforms are parallel to each other along the peripheral direction.

18 Claims, 3 Drawing Sheets

(56) References Cited

U.S. PATENT DOCUMENTS 4,438,807 A * 3/1984 Mathur ..... F28F 1/42 165/133
5,333,682 A * 8/1994 Liu ..... F28F 1/26 165/133
5,526,626 A * 6/1996 Loucks ..... E04D 1/08 428/906
5,697,430 A * 12/1997 Thors ..... F28F 1/36 165/133
6,167,950 B1 * 1/2001 Gupte ..... F28F 1/36 165/133
6,176,302 B1 * 1/2001 Takahashi ..... F28F 1/36 165/133
7,178,361 B2 * 2/2007 Thors ..... F25B 39/02 165/184
7,311,137 B2 * 12/2007 Thors ..... B21C 37/20 165/133
7,762,318 B2 7/2010 Yu
7,789,127 B2 9/2010 Lu
7,841,391 B2 * 11/2010 Hao et al. ..... 165/133
2007/0034361 A1 * 2/2007 Lu et al. ..... 165/133
2007/0131396 A1 * 6/2007 Yu ..... F25B 39/04 165/133
2007/0151715 A1 * 7/2007 Yunyu ..... F28F 1/38 165/133
2007/0193728 A1 * 8/2007 Beutler ..... B21C 37/207 165/133
2008/0196876 A1 * 8/2008 Cao ..... F28F 1/36 165/181
2009/0008069 A1 1/2009 Luo

FOREIGN PATENT DOCUMENTS

CN 1982830 A 6/2007
CN 101532794 A 9/2009
CN 101556124 A 10/2009
JP S59100396 A 6/1984
WO WO-2009128831 A1 10/2009

* cited by examiner

CONDENSATION ENHANCEMENT HEAT TRANSFER PIPE

CROSS-REFERENCE TO RELATED APPLICATION

This application claims priority under 35 U.S.C. §119 to Chinese Patent Application No. 201010126915.9, titled "Condensation Enhancement Heat Transfer Pipe," filed Mar. 18, 2010. The complete disclosure of the foregoing priority application is hereby fully incorporated herein by reference.

TECHNICAL FIELD

The present invention relates generally to the field of heat transfer equipment. More particularly, the present invention is directed to a condensation enhancement heat transfer pipe for horizontal shell pipe type condenser.

BACKGROUND

In the fields of refrigeration and air conditioning, energy saving aspects and efficiency are highly desired, and thus related systems require that evaporators and condensers for such systems have improved properties. In order to improve the properties of both the evaporator and the condenser, an enhancement heat transfer pipe with a higher heat transfer property is needed.

In horizontal shell pipe type condensers, refrigeration medium outside of the pipe is condensed so as to transfer heat by phase change, and coolant, such as water, flows through the pipe so as to transfer heat. Since the refrigeration medium outside of the pipe is cooled and condensed to form a liquid film outside of the outer wall of the pipe, the heat resistance at the refrigeration medium side is greater. Accordingly, the temperature difference loss leads to a decrease of the refrigeration efficiency, which affects the heat transfer property of the heat transfer pipe.

Generally, in order to enhance the heat transfer of the condensation side through phase change, fins can be formed on the outer surface of the heat transfer pipe by a mechanical machine, and a tooth crown is knurled to form a gap so as to form a zigzag. The primary function of this design is to enhance the heat transfer surface area, and the zigzag is used to reduce the thickness of the liquid film. Additionally, since the fins have a different radius of curvature in different positions, cooling liquid flows downward and is discharged collectively through a fin channel between the fins. Accordingly, the enhancement of the effect of heat transfer can be achieved.

Even though such mechanical processes can improve the heat transfer of the condensation side, these processes still do not meet the requirements of the refrigeration equipment to the heat transfer property of the condenser. Therefore, a need exists for the enhancement of heat transfer technology so to improve the heat transfer property of the condensation heat transfer pipe.

SUMMARY OF INVENTION

The condensation enhancement heat transfer pipes described herein have higher heat transfer efficiency over conventional condensation heat transfer pipes.

In one aspect, condensation enhancement heat transfer pipes of the present invention includes a smooth pipe section, a fin section, and a transition section connecting the smooth pipe section and the fin section. The outer surface of the fin section is provided with a plurality of individual fins, each of the individual fins is in an acute shape of zigzag and forms an angle relative to the axial direction, an axial fin channel is formed between two adjacent ones of the individual fins along the axial direction, a peripheral fin channel is formed between two adjacent ones of the individual fins along the peripheral direction, an end, which is distributed along the axial direction, of each of the individual fins is provided with platforms, the fin walls are connected with the platform by an arc, and the platforms are parallel to each other along the peripheral direction.

In preferred embodiments, the number of individual fins distributed along the peripheral direction is in the range of about 60 to about 160. The distance between the fins along the peripheral direction, i.e. the width of the peripheral fin channels is in a range of from about 0.1 mm to about 0.6 mm. The thickness of the fins is in a range of from about 0.1 mm to about 0.4 mm. The height of the fins is in a range of from about 0.4 mm to about 1.5 mm. Preferably, a circular fin formed by the individual fins includes about 26 to about 60 fins arranged per inch along the axial direction, the distance between the axial fins, i.e. the width of the axial fin channels is in a range of from about 0.25 mm to about 1 mm. Preferably, the individual fins form an angle in a range of from about 20 to about 75 degrees relative to the axial direction. The depth of the platform at one end of the individual fins is in a range of from about 0.1 mm to about 0.7 mm, and the width of the platform is in a range of from about 0.1 mm to about 0.7 mm. Preferably, a circular fin fanned by the individual fins is an axial parallel fin. Preferably, a circular fin formed by the individual fins is a helical fin arranged along the axial direction, and the helical angle is in a range of from about 0.3 to about 1.5 degrees. The inner surface of the heat transfer pipe is provided with thread inner teeth, and the shape of the inner teeth is an analogous triangle which transmits from the tooth crown to the tooth root, where the tooth crown angle is in a range of from about 20 to about 70 degrees. Preferably, the inner surface of said heat transfer pipe is provided with thread inner teeth with an angle in a range of from about 30 to about 60 degrees relative to the axial direction. The number of the inner thread starts is in a range of from about 6 to about 60, and the height of the inner tooth is in a range of from about 0.1 mm to about 0.6 mm.

The condensation heat transfer pipe of the present invention improves the heat transfer coefficient of the inner surface and the outer surface of the heat transfer pipe, optimizes the heat transfer efficiency of the outside and the inside of the heat transfer pipe, and improves the whole heat transfer efficiency of the condensation enhancement heat transfer pipe when compared to conventional heat transfer pipes. The enhancement heat transfer pipe is improved due to one or more of the following reasons: (1) the present invention presses a platform on the individual fin which increases the area of the sidewall, and when the liquid film flows downward through the platform, it is further cooled to enhance the heat transfer, (2) the fin and the platform design causes the liquid film to flow through several turnings so as to reduce the thickness of the condensation liquid film to decrease the heat transfer resistance, (3) the fin sidewall and the platform are connected by an arc at a turning, and under the surface tension, the liquid film can fast flow downward, (4) the fin sidewall and the fin have several turnings which are acute, in which the condensation liquid film is the thinnest, thus the enhancement of the heat transfer property is maximized, and (5) there are inner analogous teeth in the pipe, and a suitable number of the inner teeth not only enhances the heat transfer area, but also enhances the turbulence in the pipe so as to improve the heat transfer efficiency.

These and other aspects, objects, features, and embodiments of the present invention will become apparent to those having ordinary skill in the art upon consideration of the following detailed description of illustrative embodiments exemplifying the best mode for carrying out the invention as presently perceived.

DETAILED DESCRIPTION OF THE INVENTION

Figure 1:
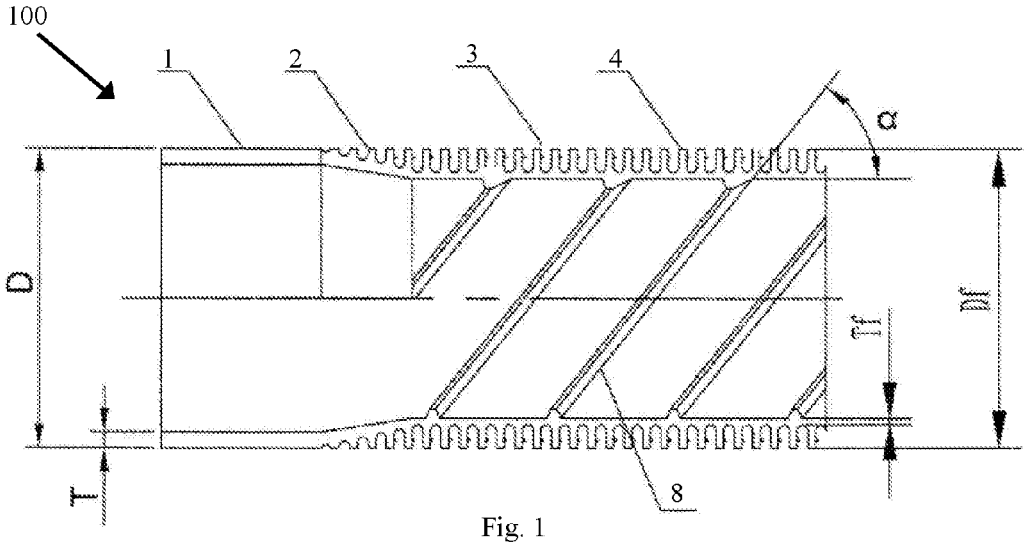
FIG. 1 is a side view of a condensation enhancement heat transfer pipe, according to an exemplary embodiment.

A condensation enhancement heat transfer pipe described herein has an improved heat transfer efficiency over conventional heat transfer pipes. The invention may be better understood by reading the following description of non-limitative, exemplary embodiments with reference to the attached drawings wherein like parts of each of the figures are identified by the same reference characters.

Figure 2:
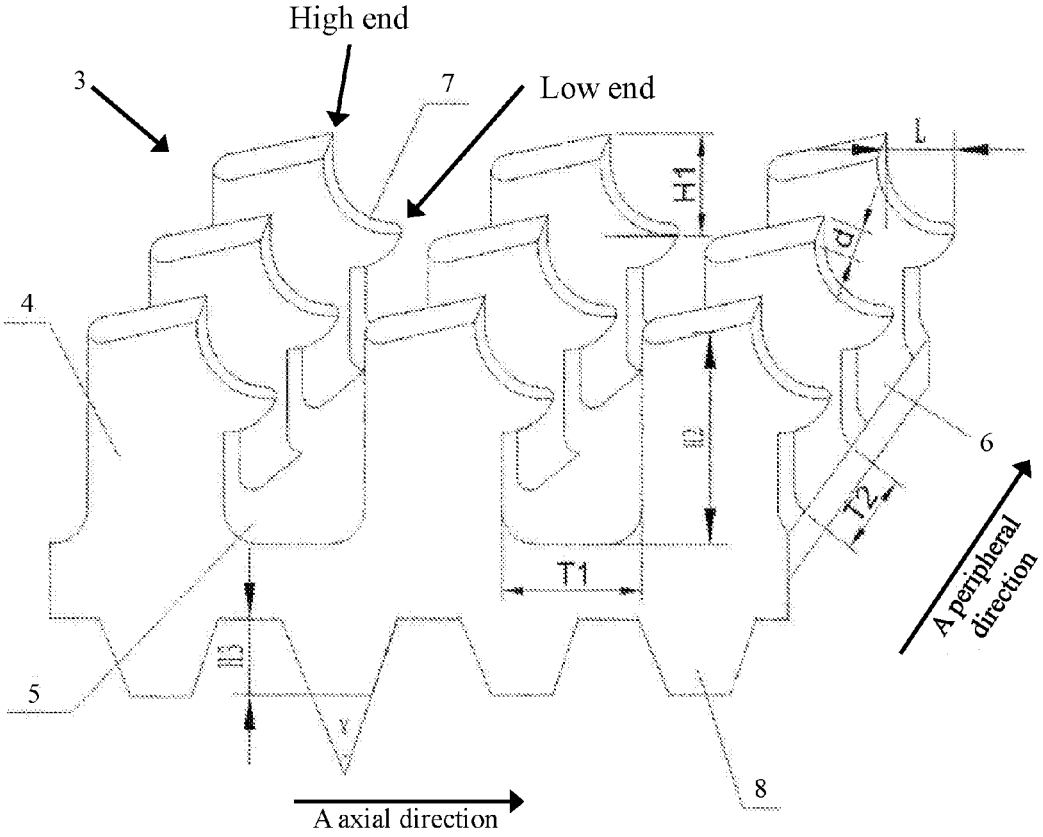
FIG. 2 is a perspective view of the structure of the fin section of the condensation enhancement heat transfer pipe of FIG. 1, according to an exemplary embodiment.
Figure 3:
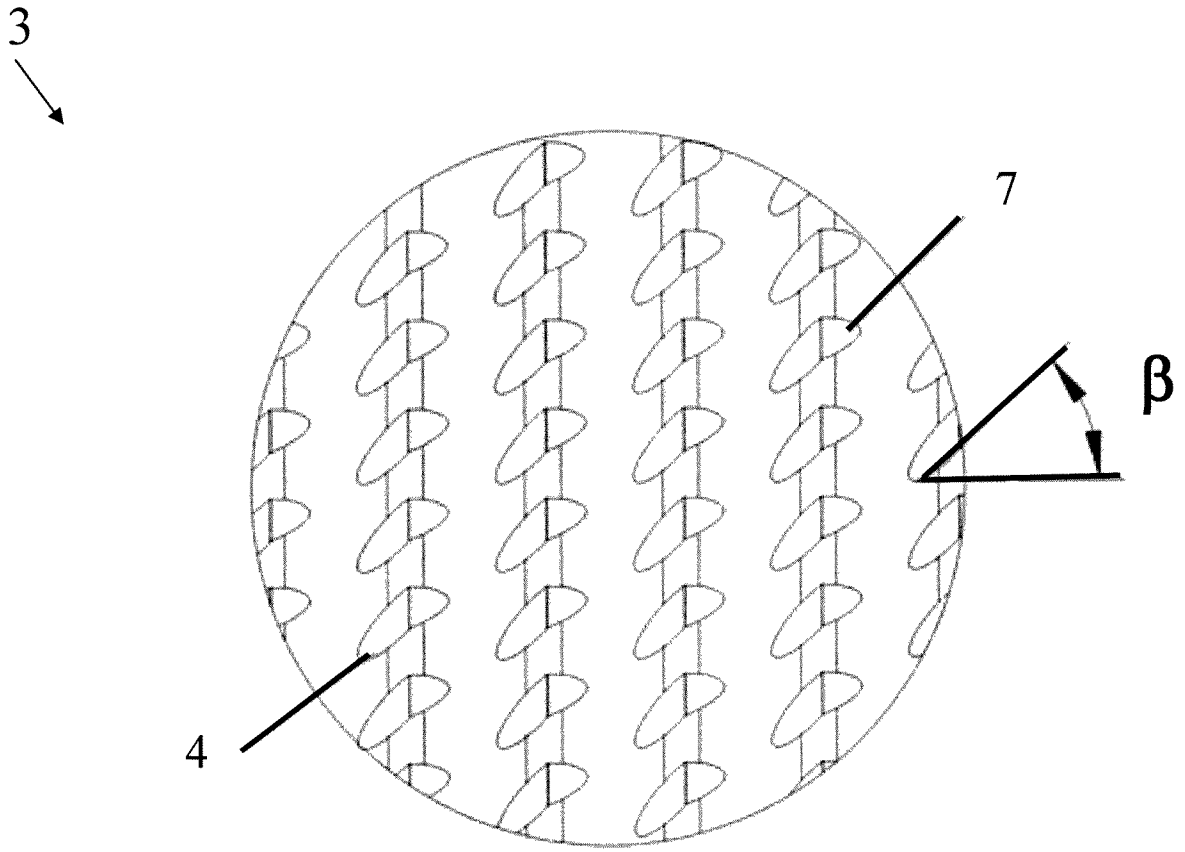
FIG. 3 is a top view of the fin section of FIG. 2, according to an exemplary embodiment.

FIG. 1 is a side view of a condensation enhancement heat transfer pipe 100, according to an exemplary embodiment. FIG. 2 is a perspective view of a fin section 3 of the condensation enhancement heat transfer pipe 100, and FIG. 3 is a top view of the fin section 3. Referring to FIGS. 1-3, the condensation enhancement heat transfer pipe 100 includes a smooth pipe section 1, the fin section 3, and a transition section 2 connecting said smooth pipe section 1 and said fin section 3. The outer surface of the fin section 3 includes a plurality of individual fins 4. Each of the individual fins 4 has an acute shape of zigzag and forms an angle β relative to an axial direction. An axial fin channel 5 is formed between two adjacent individual fins 4 along the axial direction, and a peripheral fin channel 6 is formed between two adjacent individual fins 4 along a peripheral direction. Each of the individual fins 4 includes an end, distributed along the axial direction, having a platform 7. The walls of each of the individual fins 4 are connected to the platforms 7 by an arc, with a turning angle present at the connection location. The platforms 7 are parallel to each other along the peripheral direction.

As shown in FIG. 1, the smooth pipe section 1 is a raw pipe which has not been processed. In certain exemplary embodiments, the diameter D of the smooth pipe section 1 ranges from about 12 millimeters (mm) to about 26 mm. In certain embodiments, the outer diameter Df of the fin section 3 is no greater than the diameter D of the smooth pipe section 1. The thickness T of the wall of the smooth pipe section 1 ranges from about 0.5 mm to about 1.5 mm. The transition section 2 is a portion with an incomplete fin.

A special rolling machine can be utilized to shape the fin section 3 under spinning of a pair of a thread core and a cut, while the exterior and the interior of the pipe 100 are processed at the same time. In certain exemplary embodiments, methods of processing include first distributing a helical fin along the axial direction on the outer surface of the body of the heat transfer pipe 100. In certain exemplary embodiments, the helical range is from about 0.3 to about 1.5 degrees. A side of the helical fin is spun by an annular cut to form a platform 7. The helical fin is then divided by a cut into the separate individual fins 4. The platform 7 is formed by spinning an end of the fin. Therefore, material of the heat transfer pipe is not added during the formation of the platform 7, and only heat transfer area of the heat transfer pipe is added, thus saving the material of the heat transfer pipe and the manufacturing cost. Additionally, the side walls of the fin 4 and the platform 7 are connected by an arc to facilitate the flow of the condensing liquid, as liquid film can flow quickly downward under the act of the surface tension so that the heat transfer property is maximized. In certain alternative embodiments, the platform 7 may be positioned elsewhere in the individual fin 4, and is not limited by the above description.

In certain exemplary embodiments, the individual fins 4 form an angle β in the range from about 20 to about 75 degrees relative to the axial direction. The platform 7 and the sidewall of the fin 4 are connected by an arc to form a turning, and the whole fin forms several acute locations and turnings so as to enhance the heat transfer effect. In certain exemplary embodiments, the fin section 3 has an average thickness Tf in the range of from about 0.4 mm to about 1.0 mm.

In certain embodiments, a circular fin formed by the individual fins 4 includes about 26 to about 60 fins arranged per inch along the axial direction, the distance between the axial fins, i.e. the distance between two adjacent individual fins 4 along the axial direction. A width T1 of the axial fin channels 5 can range from about 0.25 mm to about 1 mm. In certain embodiments, the number of individual fins 4 on the fin section 3 can include about 60 to about 160 fins distributed along the peripheral direction, the distance between the fins along the peripheral direction, i.e. a width T2 of the peripheral fin channels 6 can range from about 0.1 mm to about 0.6 mm. The arrangement of the axial fin channels 5 and the peripheral fin channels 6 enhances the heat transfer area of the fin 4 and provides a passage for the condensing liquid to flow downward so as to achieve the effect to enhance the condensation heat transfer.

In certain exemplary embodiments, the thickness d of the individual fins 4 ranges from about 0.1 mm to about 0.4 mm, and the height H2 of the fins can range from about 0.4 mm to about 1.5 mm. The depth H1 of the platform 7 at one end of the individual fins 4 can be in the range of from about 0.1 mm to about 0.7 mm, and the width L of the platform can be in the range of from about 0.1 mm to about 0.7 mm, where the thickness is equal to the thickness of the fin. In certain exemplary embodiments, the circular fins formed by the individual fins 4 along the periphery of the pipe body are helical fins that are parallel to each other and are arranged along the axial direction, where the helical angle can be in the range of from about 0.3 to about 1.5 degrees.

In certain exemplary embodiments, a thread core and a cut pair can be used to process the thread inner teeth 8 within the inner surface of the heat transfer pipe 100 so as to enhance the heat transfer coefficient. The shape of the thread inner teeth 8 is an analogous triangle which transmits from the tooth crown to the tooth root. The tooth crown angle γ can range from about 20 to about 70 degrees. The thread inner teeth 8 forms an angle α that can range from about 30 to about 60 degrees relative to the axial direction. The number of the inner thread starts can range from about 6 to about 60.

The height of the inner tooth H3 can range from about 0.1 to about 0.6 mm. The arrangement of the thread inner teeth 8 can destroy the heat transfer boundary layer of the fluid and enhances the turbulence of the fluid in the pipe 100, therefore enhancing the convection heat transfer coefficient such that the whole heat transfer coefficient is further improved.

In certain embodiments, when the condensation enhancement heat transfer pipe 100 is processed and manufactured, the body of the pipe 100 may be constructed from copper, a copper alloy, or other metal material. The structure of the condensation enhancement heat transfer pipe 100 of the present invention is described further below. In an exemplary embodiment, the outer diameter D is 25.4 mm, and the wall thickness T is 1.2 mm. The fin section 3 is shaped by the spinning of a thread core and cut pair under a special press, while the exterior and interior of the pipe 100 are integrally processed at the same time. The helical fins are arranged along the axial direction on the outer surface of the heat transfer pipe. The axial distance T1 is 0.406 mm. An annular cut is used to spin a side of the helical fin to form a platform 7. The depth H1 of the platform is 0.2 mm, and the width L of the platform is 0.14 mm. The cut is then used to divide the helical fin to separate individual fins 4. The individual fins 4 form an axial angle β of 45 degrees with 150 fins distributed along per periphery, the peripheral distance between the fins, i.e. the width T2 of the peripheral fin channel is about 0.28 mm. The presence of the platform 7 and the individual fins 4 enhance the heat transfer area. Several acute locations and turnings are also formed from the top of the individual fins 4 to the platform 7 so as to enhance the effect of the heat transfer.

The thread inner teeth 8 can be manufactured at one time to enhance the heat transfer coefficient. In certain embodiments, the starts of the inner thread are 45, the height H3 of the inner teeth 8 is 0.35 mm with an angle α of 45 degrees, and the tooth crown angle γ is 30 degrees. The interior of the pipe 100 is provided with a thread such that the heat transfer area is enlarged and the turbulence in the pipe 100 is enhanced, as the boundary layer is destroyed so as enhance the heat transfer. When the exterior of the pipe 100 is enhanced, the heat resistances of the inside and the outside of the heat transfer are closer, and the heat transfer property of the whole heat transfer pipe 100 is improved to a larger extent.

Figure 4:
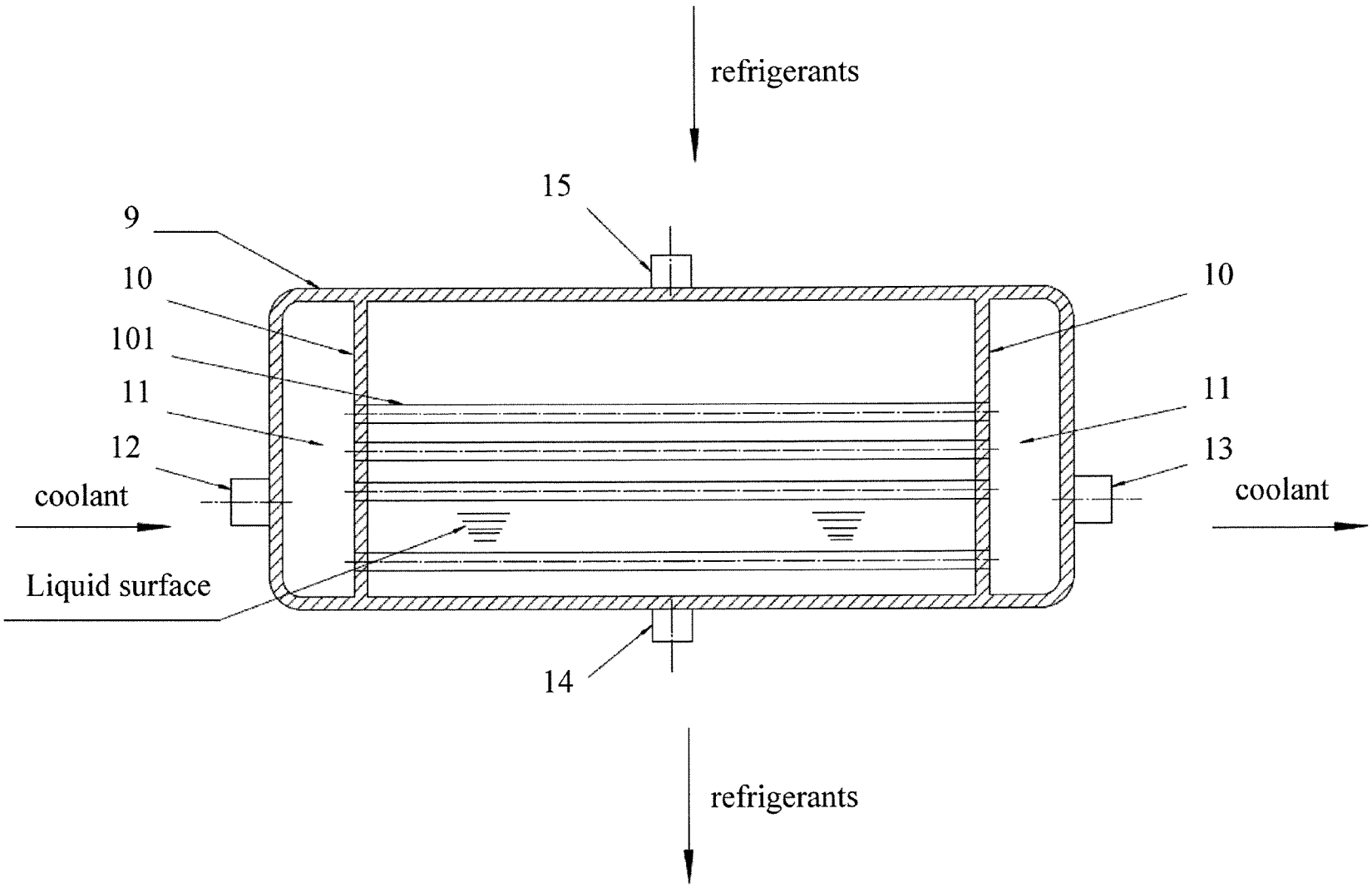
FIG. 4 depicts a system in which the condensation enhancement heat transfer pipe of FIG. 1 can be used, according to an exemplary embodiment.

Referring now to FIG. 4, FIG. 4 depicts a condenser system in which the condensation enhancement heat transfer pipe 100 can be used, according to an exemplary embodiment. A body 101 of the heat transfer pipe 100 of the present invention is expansively connected to a pipe plate 10 of a condenser 9. A coolant (such as water) flows from a water chamber 11 and an inlet 12 through the inside of the heat transfer pipe body 101 so as to exchange heat with the outside coolant of the pipe 100, and then flows out of the water chamber 11 and an outlet 13. A coolant gas flows from an inlet 15 into the condenser 9, is cooled by the heat transfer pipe body 101, and is cooled as a liquid outside the wall of the pipe to flow out of the condenser through an exit 14. Due to the heat discharge of the coolant under condensation, the coolant in the pipe 100 is heated. Because the three-dimensional structure of the inner wall and the outer wall of the pipe body 101 is facilitated to enhance heat transfer, the heat property of the whole condenser is effectively improved.

In certain exemplary embodiments, when the cooling medium $CHCl_2CF_3$, known commonly as R123, is used, the heat transfer property at the condensing side is improved by 15% over conventional systems. To improve the heat transfer property and cost performance of the system, the condensation heat transfer pipe is preferably made of copper, or may be selected from a metal material such as a copper alloy, aluminum, aluminum alloy, or low carbon steel. One having ordinary skill in the art will recognize that other suitable materials exist to construct the heat transfer pipe.

The condensation heat transfer pipe of the present invention improves the heat transfer coefficient of the inner surface and the outer surface of the heat transfer pipe, optimizes the heat transfer efficiency of the outside and the inside of the heat transfer pipe, and improves the whole heat transfer efficiency of the condensation enhancement heat transfer pipe. The primary reasons are as follows: (1) the present invention presses a platform on the individual fin which increases the area of the sidewall, and when the liquid film flows downward through the platform, it is further cooled to enhance the heat transfer, (2) the fin and the platform design causes the liquid film to flow through several turnings so as to reduce the thickness of the condensation liquid film to decrease the heat transfer resistance, (3) the fin sidewall and the platform are connected by an arc at a turning, and under the surface tension, the liquid film can fast flow downward, (4) the fin sidewall and the fin have several turnings which are acute, in which the condensation liquid film is the thinnest, thus the enhancement of the heat transfer property is maximized, and (5) there are inner analogous teeth in the pipe, and a suitable number of the inner teeth not only enhances the heat transfer area, but also enhances the turbulence in the pipe so as to improve the heat transfer efficiency.

While numerous changes may be made by those having ordinary skill in the art, such changes are encompassed within the spirit of this invention as defined by the appended claims. Furthermore, no limitations are intended to the details of construction or design herein shown, other than as described in the claims below. It is therefore evident that the particular illustrative embodiments disclosed above may be altered or modified and all such variations are considered within the scope and spirit of the present invention. The terms in the claims have their plain, ordinary meaning unless otherwise explicitly and clearly defined by the patentee.

What is claimed is:

1. A condensation enhancement heat transfer pipe comprising:

a pipe section;

a fin section comprising a plurality of individual fins positioned on an outer surface of said fin section, wherein each of said individual fins comprises a slanted top wall, a non-flat platform having a high end and a low end, and a sidewall located underneath an arc, wherein the platform adjoins the slanted top wall at the high end and adjoins the arc at the low end, and wherein the high end and the low end facilitate flow of condensation liquid from said high end to said low end; and further wherein a sidewall of the fin forms an angle relative to an axial direction of said pipe; and a transition section connecting said pipe section and said fin section.

2. The condensation enhancement heat transfer pipe of claim 1, wherein about 60 to about 160 of individual fins are distributed along the peripheral direction.

3. The condensation enhancement heat transfer pipe of claim 1, wherein a peripheral fin channel is positioned between two adjacent ones of said individual fins along a peripheral direction, and wherein a width of said peripheral fin channels is in a range of from about 0.1 mm to about 0.6 mm.

4. The condensation enhancement heat transfer pipe of claim 1, wherein a thickness of the fins is in a range of from about 0.1 mm to about 0.4 mm.

5. The condensation enhancement heat transfer pipe of claim 1, wherein a height of the fins is in a range of from about 0.4 mm to about 1.5 mm.

6. The condensation enhancement heat transfer pipe of claim 1, wherein a circular fin formed by said individual fins comprises from about 26 to about 60 fins arranged per inch along the axial direction.

7. The condensation enhancement heat transfer pipe of claim 1, wherein a width of axial fin channels is in a range of from about 0.25 to about 1 mm.

8. The condensation enhancement heat transfer pipe of claim 1, wherein said angle is in a range of from about 20 degrees to about 75 degrees.

9. The condensation enhancement heat transfer pipe of claim 1, wherein a depth of a platform connected to the high end of said individual fins is in a range of from about 0.1 mm to about 0.7 mm.

10. The condensation enhancement heat transfer pipe of claim 1, wherein a width of a platform connected to the high end of said slanted wall is in a range of from about 0.1 mm to about 0.7 mm.

11. The condensation enhancement heat transfer pipe of claim 1, wherein a circular fin formed by said individual fins is an axial parallel fin.

12. The condensation enhancement heat transfer pipe of claim 1, wherein a circular fin formed by said individual fins is a helical fin arranged along the axial direction and having a helical angle in a range of from about 0.3 degrees to about 1.5 degrees.

13. The condensation enhancement heat transfer pipe of claim 1, wherein an inner surface of said heat transfer pipe includes thread inner teeth.

14. The condensation enhancement heat transfer pipe of claim 13, wherein a shape of said inner teeth is an analogous triangle with a transition from a tooth crown to a tooth root.

15. The condensation enhancement heat transfer pipe of claim 14, wherein a tooth crown angle is in a range of from about 20 degrees to about 70 degrees.

16. The condensation enhancement heat transfer pipe of claim 13, wherein a height of the inner teeth is in a range of from about 0.1 mm to about 0.6 mm.

17. The condensation enhancement heat transfer pipe of claim 13, wherein the thread inner teeth forms an angle in a range of from about 30 degrees to about 60 degrees relative to the axial direction.

18. The condensation enhancement heat transfer pipe of claim 13, wherein the inner surface of the pipe comprises from about 6 to about 60 inner thread heads.

* * * * *